US012729866B2

(12) United States Patent
Elliott et al.

(10) Patent No.: US 12,729,866 B2
(45) Date of Patent: Sep. 8, 2026

(54) SECONDARY OUTSIDE AIR PATH FOR A HEAT PUMP

(71) Applicant: Flo Energy Solutions Inc., Toronto (CA)

(72) Inventors: Bryan Elliott, Toronto (CA); Saman Zamanzadeh Haratbar, Newmarket (CA); Laura Janke Semidey, Woodstock, GA (US); Peter Graham Reist, Aurora (CA)

(73) Assignee: Flo Energy Solutions Inc., Toronto (CA)

( * ) Notice: Subject to any disclaimer, the term of this patent is extended or adjusted under 35 U.S.C. 154(b) by 106 days.

(21) Appl. No.: 18/637,609

(22) Filed: Apr. 17, 2024

(65) Prior Publication Data

US 2024/0353122 A1 Oct. 24, 2024

Related U.S. Application Data

(60) Provisional application No. 63/497,223, filed on Apr. 20, 2023.

(51) Int. Cl.
*F24F 3/14* (2006.01)
*F24F 11/00* (2018.01)

(52) U.S. Cl.
CPC ..... *F24F 3/14* (2013.01); *F24F 2011/0002* (2013.01)

(58) Field of Classification Search
CPC ..... F24F 3/14; F24F 2011/0002
See application file for complete search history.

(56) References Cited

U.S. PATENT DOCUMENTS 2,376,859 A * 5/1945 Benn ..... F25B 29/003 236/1 C
2010/0012291 A1* 1/2010 Sporie ..... F24F 5/0035 165/104.34

(Continued)

FOREIGN PATENT DOCUMENTS

JP 2005345001 A 12/2005

OTHER PUBLICATIONS

International Search Report and Written Opinion from International Application No. PCT/CA2024/050497 mailed Jun. 28, 2024.

(Continued)

*Primary Examiner* — David J Teitelbaum
(74) *Attorney, Agent, or Firm* — Ballard Spahr LLP

(57) ABSTRACT

A heat pump is provided that is alternately operable in a heating mode for heating an interior space under cold or cool ambient conditions and in a cooling or dehumidification mode for cooling the interior space under warm or hot ambient conditions. The heat pump has a direct expansion (DX) coil that operates as a condenser coil for heating air passing over said DX coil when the heat pump is operated in the heating mode. The heat pump has a first outside air path that delivers outside air over the DX coil. The heat pump additionally has a second outside air airflow path that bypasses the DX coil. The heat pump optionally includes heat reclaim coil. When the heat pump has a heat reclaim coil, the second outside air airflow path is upstream of the heat reclaim coil for delivering outside air over the heat reclaim coil.

7 Claims, 2 Drawing Sheets

(56) References Cited

U.S. PATENT DOCUMENTS

| | | | | |
|---|---|---|---|---|
| 2012/0247132 | A1 | 10/2012 | Lakdawala et al. | |
| 2013/0320573 | A1* | 12/2013 | Fisher | F24F 6/02 261/127 |
| 2014/0260368 | A1 | 9/2014 | Wintemute et al. | |
| 2016/0216717 | A1* | 7/2016 | Elliott | G05D 7/0658 |
| 2019/0366794 | A1 | 12/2019 | Agathocleous et al. | |
| 2020/0018495 | A1 | 1/2020 | Williams | |
| 2020/0284464 | A1* | 9/2020 | Abdel-Salam et al. | F24F 3/06 |

OTHER PUBLICATIONS

International Preliminary Report on Patentability from International Application No. PCT/CA2024/050497 mailed Oct. 30, 2025.

* cited by examiner

SECONDARY OUTSIDE AIR PATH FOR A HEAT PUMP

TECHNICAL FIELD

The application is directed generally to heat pumps for use as a heating source for supermarkets and buildings, where outside air ventilation is required.

BACKGROUND OF THE INVENTION

The objective of reducing carbon emissions has led supermarkets and commercial building owners to seek alternative heating sources to minimize natural gas usage. A heating source that is gaining popularity is the heat pump. The heat pump utilizes an air conditioner's refrigerant vapor-compression cycle to "pump" heat from outside a structure and release it indoors. Heat pumps are quickly gaining popularity because of their ability to heat a space at 250% higher efficiency than traditional electric strip heating.

One limitation to a heat pump, is the inability to operate at low ambient conditions. Especially for applications in which outdoor ventilation air is required in the space, heat pumps cannot operate below a 40° F. to 50° F. DX coil entering air temperature (mix of return air and outside air) due to a limitation of the compressor operating window. This limitation prohibits heat pumps from being used for heating an interior space in cold climates where high outside air volumes are required during periods when heating is needed most.

For applications in supermarkets, another limitation to the traditional heat pump is the inability to utilize the total capacity of the refrigeration system's waste heat throughout heating season via a heat reclaim coil. The heat reclaim coil is traditionally located downstream of the DX coil and is used to provide supplemental heating throughout a heating mode as well as to reheat the supply air stream during a cooling or dehumidification mode. Because the reclaim coil is required to be downstream from the DX coil for dehumidification reheating, the heat transfer efficiency of the heat reclaim coil is significantly reduced during a heat pump's heating mode due to the higher heat reclaim coil entering air temperature produced by the hot DX coil. There is a need for a heat pump having an air path configuration that permits for operation of the heat pump at low ambient conditions.

SUMMARY

A heat pump is provided that is alternately operable in a heating mode for heating an interior space under cold or cool ambient conditions and in a cooling or dehumidification mode for cooling the interior space under warm or hot ambient conditions. The heat pump has a direct expansion (DX) coil that operates as a condenser coil for heating air passing over the DX coil when the heat pump is operated in the heating mode. The heat pump has a first outside air airflow path that delivers outside air over the DX coil. The heat pump additionally has a second outside air airflow path that bypasses the DX coil. The heat pump optionally includes a heat reclaim coil. When the heat pump has a heat reclaim coil, the second outside air airflow path is upstream of the heat reclaim coil for delivering outside air over the heat reclaim coil after bypassing the DX coil.

According to one aspect, there is provided a heat pump that is alternately operable in a heating mode for heating an interior space under cold or cool ambient conditions and in a cooling or dehumidification mode for cooling the interior space under warm or hot ambient conditions. The heat pump comprises a housing defining a chamber. The housing further defines a first outside air inlet for receiving outside air into the chamber, a second outside air inlet for receiving outside air into the chamber, the first outside air inlet being spaced apart from second an outside air inlet, a return air inlet for receiving return air into the chamber from the interior space, and a supply air outlet for delivering air from the chamber to the interior space. The heat pump further comprises a DX coil located in the chamber, the DX coil operating as a condenser coil for heating air passing over the DX coil in the chamber when the heat pump is operated in the heating mode. The housing defines a first outside air airflow path therein communicating between the first outside air inlet over the DX coil and to the supply air outlet for delivering outside air from the first outside air inlet over the DX coil to said interior space. The housing defines a second outside air airflow path therein communicating between the second outside air inlet to the supply outlet for delivering outside air from the second outside air inlet to the supply air outlet, whereby the second outside air airflow path bypasses the DX coil. The housing further defines a return air airflow path communicating between the return air inlet and the supply air outlet over the DX coil for delivering return air from the interior space over the DX coil and back to the interior space through the supply air outlet, whereby the return air airflow path joins the first outside air airflow path upstream from the DX coil and joins the second outside air airflow path downstream from the DX coil.

An inlet damper for the second outside air airflow path can be located on any side of the housing (top, bottom or side), or as part of a separate structure outside of the heat pump that switches the outside air and return air streams.

According to another aspect, the heat pump further comprises a heat reclaim coil located in the chamber downstream from the DX coil, whereby the second outside air airflow path communicates between the second outside air inlet and the supply outlet air outlet over the heat reclaim coil while bypassing the DX coil for delivering outside air from the second outside air inlet to the supply air outlet.

BRIEF DESCRIPTION OF THE DRAWINGS

The drawings illustrate an embodiment of the present disclosure.

DETAILED DESCRIPTION

Figure 1:
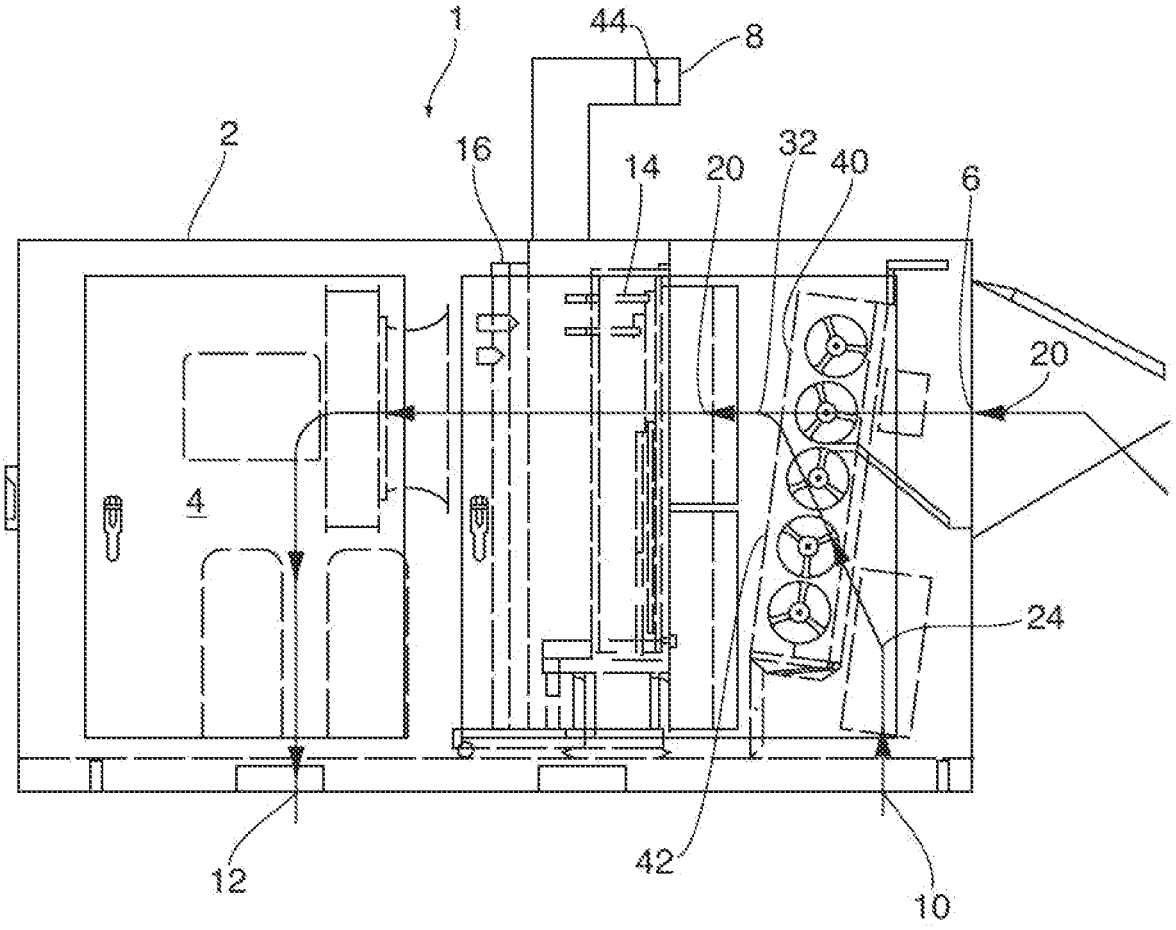
FIG. 1 is a schematic diagram of a heat pump of the present disclosure showing a first air inlet open and a second air inlet closed.
Figure 2:
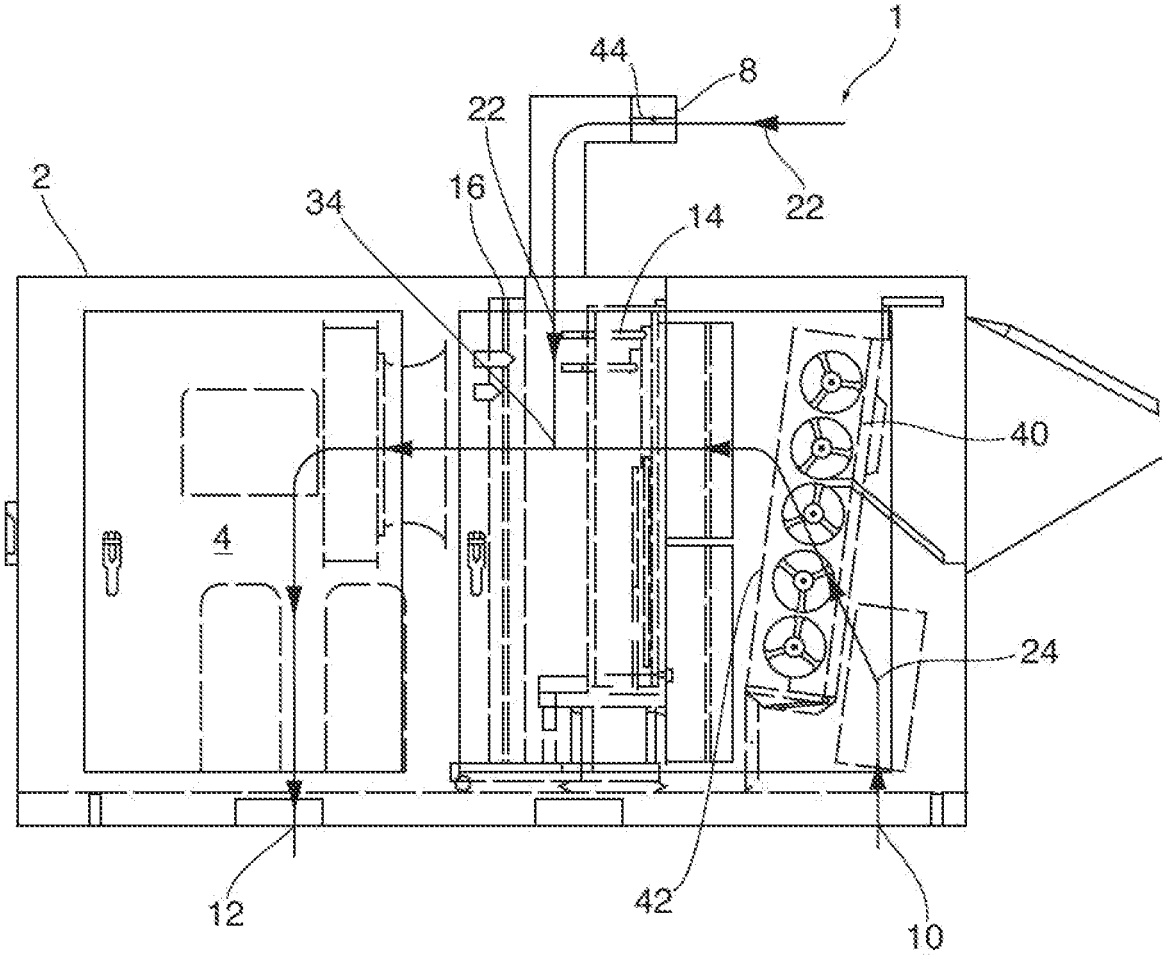
FIG. 2 is a schematic diagram of a heat pump of the present disclosure showing the first air inlet closed and the second air inlet open.

As shown in FIG. 1 and FIG. 2, a heat pump 1 is alternately operable in a heating mode for heating an interior space under cold or cool ambient conditions and in a cooling or dehumidification operation mode for cooling the interior space under warm or hot ambient conditions. The heat pump 1 can be an air source heat pump. The interior space is typically a commercial building which could be a supermarket having specific outdoor ventilation and dehumidification needs. The heat pump 1 is preferably mounted on the roof of the building having an interior space in communication with the heat pump. The heat pump can also be mounted indoors if it is water sourced.

The heat pump 1 comprises a housing 2 having an interior chamber 4 formed therein. The housing 1 has a first outside air inlet 6 for receiving outside air into the chamber 4 of the housing 2. The first outside air inlet 6 is shown in an open position in FIG. 1 and in a closed position in FIG. 2. The housing 2 further has a second outside air inlet 8 for receiving outside air into the chamber 4. The second outside air inlet 8 is shown in a closed position in FIG. 1 and in an open position in FIG. 2. The first outside air inlet 6 is spaced apart from the second outside air inlet 8. In addition, the housing 2 has a return air inlet 10 for receiving return air from the interior space into the chamber 4. The housing 2 additionally has a supply air outlet 12 for delivering air from the chamber 4 to the interior space.

A DX coil 14 is located in the chamber 4. The DX coil 14 operates as a condenser coil for heating air passing over the DX coil 14 in the chamber 4 when the heat pump 1 is operated in the heating mode. When the heat pump 1 is operated in the cooling or dehumidification operation mode, the DX coil 14 operates as an evaporator coil. The heat pump 1 preferably includes a heat reclamation coil 16. When present, the heat reclamation coil 16 is located in the chamber 4 downstream from the DX coil 14.

As shown in FIG. 1, the housing 2 defines a first outside air airflow path 20 therein communicating between the first outside air inlet 6 over the DX coil 14 and to the supply air outlet 12 for delivering outside air from the first outside air inlet 6 over the DX coil 14 to the interior space.

As shown in FIG. 2, the housing 2 defines a second outside air airflow path 22 therein communicating between the second outside air inlet 8 to the supply outlet 12 for delivering outside air from the second outside air inlet 8 to the supply air outlet 12 whereby said second outside air airflow path 22 bypasses the DX coil 14.

The housing 2 further defines a return air airflow path 24 communicating between the return air inlet 10 and the supply air outlet 12 over the DX coil 14 for delivering return air from the interior space over the DX coil 14 and back to the interior space through the supply air outlet 12. As shown in FIG. 1, the return air airflow path 24 joins said first outside air airflow path 20 at a junction 32 upstream from the DX coil 14. As shown in FIG. 2, air from the second outside air airflow path 22 and the return air airflow path 24 join at a second junction 34 downstream from the DX coil 14.

A first outside air damper 40 is preferably operatively connected to the first outside air inlet 6. The first outside air damper 40 is preferably moveable between an open position permitting outside air to flow through the first outside air airflow path 20, partially closed positions permitting a limited amount of outside air to flow into the first outside air airflow path 20 and a closed position where the first outside air inlet 6 is closed.

A second outside air damper 44 is preferably operatively connected to the second outside air inlet 8. The second outside air damper is preferably moveable between an open position as shown in FIG. 2 permitting outside air to flow into the second outside air airflow path 22, and a closed position as shown in FIG. 1 where the second outside air inlet 8 is closed. The second outside air damper 44 can be located on any side of the housing (top, bottom or side), or as part of a separate structure outside of the heat pump that switches the outside air and return air streams.

A return air damper 42 preferably is operatively connected to the return air inlet 10. The return air damper 42 is preferably moveable between an open position permitting air to flow through the return airflow path 24, partially closed positions permitting a limited amount of air to flow into the return airflow path 24 and a closed position where the return air inlet 10 is closed.

A modulating actuator (not shown) is operatively connected to the first outside air damper 40, to the second outside air damper 44 and the return air damper 42 for operating the first outside air damper 40, the second outside air damper 44 and the return air damper 42.

The heat pump 1 of the present disclosure introduces air through the second outside air inlet 8 into the second outside airflow path 22 into the interior chamber 4 downstream from the DX coil 14 and upstream of the heat reclaim coil 16 when the heat pump includes the heat reclaim coil 16. When operated in the heating mode, the heat pump's DX coil 14 is used to heat the air from the return air airflow path 24. The temperature of this air is typically above 70° F. The first outside air airflow path 20, the second outside air airflow path 22 and the return air airflow path 24 then mix at the second junction 34 upstream of the heat reclaim coil 16, resulting in a supply air temperature high enough to be sent to the interior space after the air passes over the heat reclaim coil 16. As a result of this configuration, the heat pump only has to make use of the DX coil to heat the air in the return air airflow path 24 thereby prolonging the operation of the heat pump when operated in the heating mode throughout the heating season by keeping the DX coil entering temperature high. In addition, introducing the second outside air airflow path 22 downstream of the DX coil 14 and upstream of the heat reclaim coil 16, reduces the entering temperature of the heat reclaim coil 16, and increases the effectiveness of heat reclaim throughout the heating months. This maximizes the utilization of "free heat".

An intelligent control strategy is employed to operate the first and second outside air dampers 40, 44 in addition to the return air damper 42. The intelligent control strategy is selected to optimize the amount of air entering through the first and second outside air airpaths 20, 22 respectively and the return airpath 24 in order to maximize heating efficiency at low ambient conditions. The specific relative opening of the respective dampers depends upon the specific ambient temperature conditions and the volume of outside air ventilation required. For example, the second outside air inlet 8 is opened allowing outside air to flow into the second outside air airflow path 22 when the space and ambient conditions require heating. The second outside air inlet 8 is closed during cooling or dehumidification operation when the heating mode is inactive. For applications with large outside air volume requirements, the control strategy optimizes outside air flow through both the first outside air airflow path 20 and the second outside air airflow path 22, simultaneously throughout heating mode.

When in a cooling or dehumidification mode, the first outside air damper 40 will be opened to allow the outside air to be cooled by the DX coil 14, while the second outside air damper 44 will remain closed. When the mode switches to a heating operation, the second outside air damper 44 will open, and the first outside air damper 40 will begin to close. This allows outside air to bypass the DX coil 14 and prolong the run-time of the heat pump. The outside air traveling through the second inlet 8 in a heating operation will then travel over the heat reclaim coil 16 to be heated with the refrigeration system's waste heat. If no reclaim coil is present, the outside air traveling through the second inlet 8 will mix with the heated return air coming from the DX coil 14 and supplied to the space. The return air coming from the DX 14 coil will be warm enough to supply temperatures above room temperature when mixed with the cool outside air from the second outside air inlet 8.

During heating operation, the first and second outside air dampers 40, 44 can be modulated to intermediate positions in order to maintain the mixed air inlet temperature entering the DX coil 14 above the heat pump ambient cutoff temperature (i.e. above 45° F.). Both the first and second outside air dampers 40, 44 will modulate simultaneously to maintain the total required outside air volume (total=first inlet+second inlet).

It is not essential that the heat pump have a heat reclaim coil. The heat reclaim effectiveness provided by the presence of a heat reclaim coil provides a benefit especially where dehumidification is required. The mixing of heated return air and air from the second outside air airflow path 22 at junction 34 provides a high enough supply air temperature to be sent to the interior space.

The second outside air inlet 8 can be located anywhere on a heat pump unit or implemented in ductwork prior to the unit, as long as the outside air is introduced downstream of the DX coil 14 and upstream of the heat reclaim coil 16, if provided.

The presence of the second outside air airflow path 22 provides a benefit to any heat pump that is designed to provide significant outdoor ventilation air to a space, not just a multi-path unit. For example, the second outside air airflow path 22 also provides a benefit to traditional roof-top units. While various aspects and embodiments have been disclosed herein, other aspects and embodiments are contemplated. The various aspects and embodiments disclosed herein are for purposes of illustration and are not intended to be limiting.

The invention claimed is:

1. A heat pump alternately operable in a heating mode for heating an interior space under cold or cool ambient conditions and in a cooling or dehumidification mode for cooling the interior space under warm or hot ambient conditions, the heat pump comprising:

a housing defining a chamber, the housing further defining a first outside air inlet for receiving outside air into said chamber, a second outside air inlet for receiving outside air into said chamber, the first outside air inlet being spaced apart from the second outside air inlet, a return air inlet for receiving return air into the chamber from said interior space, and a supply air outlet for delivering air from the chamber to said interior space; and a DX coil located in the chamber, said DX coil operating as a condenser coil for heating air passing over said DX coil in the chamber when the heat pump is operated in the heating mode, said housing defining a first outside air airflow path therein communicating between said first outside air inlet over said DX coil and to said supply air outlet for delivering outside air from said first outside air inlet over said DX coil to said interior space, said housing defining a second outside air airflow path therein communicating between said second outside air inlet to said supply outlet for delivering outside air from said second outside air inlet to said supply air outlet, whereby said second outside air airflow path bypasses said DX coil, said housing further defining a return air airflow path communicating between said return air inlet and said supply air outlet over said DX coil for delivering return air from the interior space over said DX coil and back to said interior space through said supply air outlet, whereby said return air airflow path joins said first outside air airflow path upstream from the DX coil and joins said second outside air airflow path downstream from said DX coil, a first outside air damper attached to the housing and communicating with the first outside air inlet, the first outside air damper being moveable between an open position in the cooling or dehumidification mode permitting outside air to flow through said first outside air airflow path, partially closed positions in the heating mode permitting a limited amount of outside air to flow through said first outside air airflow path and a closed position in the heating mode where the first outside air inlet is closed, and a second outside air damper attached to the housing and communicating with the second outside air inlet, the second outside air damper being moveable between an open position in the heating mode permitting outside air to flow through said second outside air airflow path, and a closed position in the cooling or dehumidification mode where the second outside air inlet is closed.

2. The heat pump according to claim 1 further comprising a heat reclaim coil located in the chamber downstream from said DX coil, whereby said second outside air airflow path communicates between said second outside air inlet and said supply air outlet over said heat reclaim coil while bypassing said DX coil for delivering outside air from said second outside air inlet to said supply air outlet.

3. The heat pump according to claim 2 wherein the return air airflow path joins the second outside air airflow path upstream from the heat reclaim coil.

4. The heat pump according to claim 1 further comprising a modulating actuator operatively connected to the first outside air damper and the second outside air damper for operating the first outside air damper and the second outside air damper.

5. The heat pump according to claim 4 wherein the first outside air damper is partially closed or fully closed when the heat pump is operated in heating mode and wherein the second outside air damper is fully open when the heat pump is operated in the heating mode.

6. The heat pump according to claim 4 wherein the first outside air damper is partially closed or fully closed when the heat pump is operated in heating mode and wherein the second outside air damper is partially open when the heat pump is operated in the heating mode.

7. A heat pump alternately operable in a heating mode for heating an interior space under cold or cool ambient conditions and in a cooling or dehumidification mode for cooling the interior space under warm or hot ambient conditions, the heat pump comprising:

a housing defining a chamber, the housing further defining a first outside air inlet for receiving outside air into said chamber, a second outside air inlet for receiving outside air into said chamber, the first outside air inlet being spaced apart from a second outside air inlet, a return air inlet for receiving return air into the chamber from said interior space, and a supply air outlet for delivering air from the chamber to said interior space;

a DX coil located in the chamber, said DX coil operating as a condenser coil for heating air passing over said DX coil in the chamber when the heat pump is operated in the heating mode, said housing defining a first outside air airflow path therein communicating between said first outside air inlet over said DX coil and to said supply air outlet for delivering outside air from said first outside air inlet over said DX coil to said interior space, said housing defining a second outside air airflow path therein communicating between said second outside air inlet to said supply outlet for delivering outside air from said second outside air inlet to said supply air outlet, whereby said second outside air airflow path bypasses said DX coil, said housing further defining a return air airflow path communicating between said return air inlet and said supply air outlet over said DX coil for delivering return air from the interior space over said DX coil and back to said interior space through said supply air outlet, whereby said return air airflow path joins said first outside air airflow path upstream from the DX coil and joins said second outside air airflow path downstream from said DX coil;

said heat pump further comprising a heat reclaim coil located in the chamber downstream from said DX coil, whereby said second outside air airflow path communicates between said second outside air inlet and said supply air outlet over said heat reclaim coil while bypassing said DX coil for delivering outside air from said second outside air inlet to said supply air outlet.

* * * * *